United States Patent [19]

Brochman et al.

[11] 4,372,460

[45] Feb. 8, 1983

[54] OIL-RESISTANT CLOSURE SYSTEM

[75] Inventors: Wilfred R. Brochman, Oakdale; Rodney R. Hannula, Maplewood; Bradley H. Jorgensen, Cottage Grove, all of Minn.

[73] Assignee: Minnesota Mining and Manufacturing Company, St. Paul, Minn.

[21] Appl. No.: 264,833

[22] Filed: May 18, 1981

[51] Int. Cl.[3] ..... B65D 51/22

[52] U.S. Cl. ..... 220/258; 220/260; 220/270; 220/359

[58] Field of Search ..... 220/260, 269, 270, 359, 220/268, 257, 258

[56] References Cited

U.S. PATENT DOCUMENTS

| | | | |
|---|---|---|---|
| 3,292,828 | 12/1966 | Stuart | 220/260 |
| 3,339,788 | 9/1967 | Lipske | 220/260 |
| 3,389,827 | 6/1968 | Alere et al. | 220/359 |
| 3,666,138 | 5/1972 | Morris, Jr. et al. | 220/260 |
| 3,889,844 | 6/1975 | Viker et al. | 220/359 |

*Primary Examiner*—George T. Hall

*Attorney, Agent, or Firm*—Cruzan Alexander; Donald M. Sell; William L. Huebsch

[57] ABSTRACT

An easy opening closure system comprising a container end portion having an opening therein; an exterior tape which comprises a backing and a pressure-sensitive adhesive layer and is situated circumjacent the opening; and a protective tape which comprises a barrier layer that provides a barrier to essential oils contained in beverages and an oil-resistant thermoplastic adhesive layer, the protective tape being firmly bonded to the bottom surface of the container end portion circumjacent the opening by means of the thermoplastic adhesive layer and to the exterior tape in the area of the opening by means of the pressure-sensitive adhesive layer and the thermoplastic adhesive layer.

12 Claims, 3 Drawing Figures

OIL-RESISTANT CLOSURE SYSTEM

BACKGROUND OF THE INVENTION

This invention relates to containers having easy open closure systems.

Tapes comprising pressure-sensitive adhesive layers have been found useful in closure systems for containing a variety of beverages such as natural juice and artificial drink products, e.g., see U.S. Pat. No. 3,389,827 (Abere et al.). It has also been found desirable to employ a protective tape on the bottom surface of a container end portion in order to prevent contact of the beverage with the steel edge of the opening which has been formed in that end portion. By preventing such contact, corrosion of the steel edge is desirably avoided.

Conventional protective tapes have generally comprised pressure-sensitive adhesives. Unfortunately, d-limonene and other essential oils which are constituents of natural juice and artificial drink products have a tendency to solubilize useful pressure-sensitive adhesives. As a result, conventional protective tapes often do not prevent contact of an essential oil-containing juice or drink with the steel edge, thereby often allowing corrosion of that edge to occur. Moreover, since the exterior tape also comprises a pressure-sensitive adhesive, its performance may be substantially impaired should the essential oil-containing juice or drink reach the exterior tape.

SUMMARY OF THE PRESENT INVENTION

The present invention provides an easy opening closure system comprising a container end portion having an opening therein, said closure system further comprising:

(a) an exterior tape comprising a backing and a pressure-sensitive adhesive layer, said exterior tape being situated circumjacent said opening and being firmly adhered to the top surface of said container end portion circumjacent said opening by means of said pressure-sensitive adhesive layer; and (b) a protective tape comprising a barrier layer and a thermoplastic adhesive layer firmly bonded to said barrier layer, said protective tape being firmly bonded to the bottom surface of said container end portion circumjacent said opening by means of said thermoplastic adhesive layer, and further being firmly bonded to said exterior tape in the area of said opening by means of said pressure-sensitive adhesive layer and said thermoplastic adhesive layer.

The closure system of the present invention, by reason of its inclusion of an interior protective tape comprising a barrier layer and a thermoplastic adhesive and by reason of its inclusion of an exterior tape comprising a pressure-sensitive adhesive, combines the desirable properties of essential oil-resistance and easy-opening.

The closure system of the present invention is particularly suitable for packaging natural juice and artificial drink products which contain essential oils such as d-limonene and may be used with products packed under vacuum (e.g., down to about 25 inches of mercury) or low pressure (e.g., 10 pounds per square inch). The closure system of the present invention is also particularly suitable for packaging petroleum products and products containing vegetable oils.

DETAILED DESCRIPTION OF THE INVENTION

The invention is described in more detail hereinafter with reference to the accompanying drawings wherein like reference characters refer to the same parts throughout the several views and in which.

Figure 1:
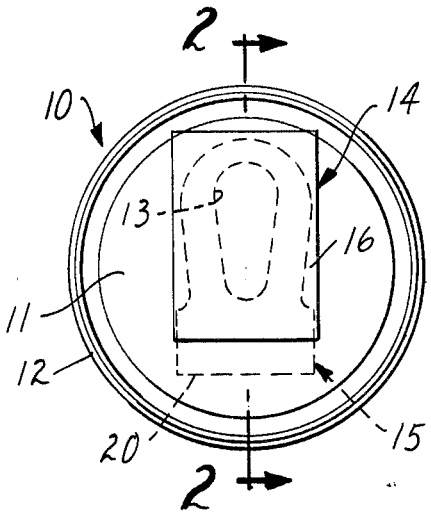
FIG. 1 is a bottom view of one embodiment of the present invention.

Thus, in FIG. 1 is shown one embodiment of a container end portion 10 (such as might be seamed onto a cylindrical, metal container body) comprising a generally flat, circular lid 11, rim 12 and preformed opening 13. Protective tape 14 is shown in one embodiment and is situated circumjacent preformed opening 13. Closure tab 15 (illustrated in phantom) is shown in one embodiment and is situated circumjacent preformed opening 13.

Figure 2:
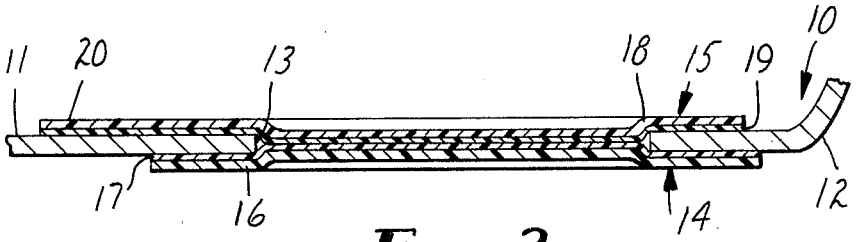
FIG. 2 is a section view taken along line 2—2 of FIG. 1.

FIG. 2 illustrates the construction of protective tape 14 and closure tab 15. Protective tape 14 comprises a barrier layer 16 which is firmly adhered to the bottom-side of the container end portion 10 by means of thermoplastic adhesive layer 17. Closure tab 15 comprises backing member 18 which is firmly adhered to the top-side of the container end portion 10 circumjacent pour hole 13 by means of pressure-sensitive adhesive layer 19. The barrier layer 16 of protective tape 14 is firmly adhered to closure tab 15 in the area of pour hole 13 by means of pressure-sensitive adhesive layer 19 of closure tab 15 and thermoplastic adhesive layer 17 of protective tape 14. Also illustrated is grip portion 20 of closure tab 15 which comprises a strip of film (not illustrate) adhered to closure tab 15 in order to prevent that portion of closure tab 15 from adhering to container end 10. Additionally, the grip portion 20 of closure tab 15 may be embossed (not illustrated) in a manner which facilitates gripping of closure tab 15.

Figure 3:
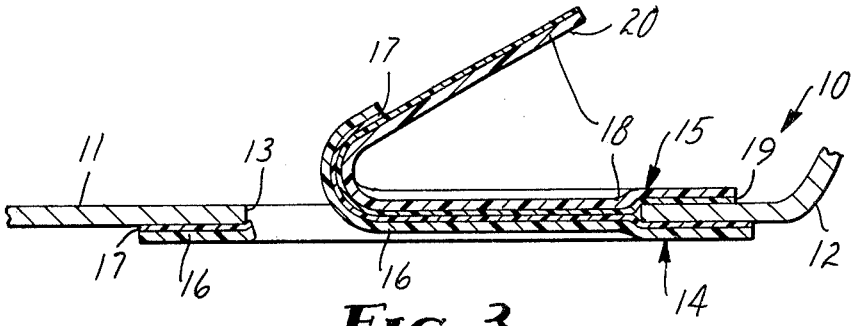
FIG. 3 is a section view similar to FIG. 2 after opening of the container has begun.

When it is desired to open the closure system depicted in FIGS. 1, 2, and 3, the consumer simply places a finger adjacent to the grip portion 20 of tab 15 and pulls that grip portion in any direction away from the container end portion 10. As closure tab 15 is removed from the container end portion 10, the portion of the protective tape 14 in the area of pour hole 13 is removed with it.

Closure tab 15 may comprise the various materials which are well known in the art for tape backings, adhesives, primers, and the like. Particularly suitable materials for tapes which are to be used as container closures have been described in U.S. Pat. Nos. 3,389,827 (Abere et al.) and 3,990,603 (Brochman), incorporated herein by reference, and are discussed below.

Backing member 18 of closure tab 15 preferably will be up to about 20 mils (500 micrometers) and most preferably about 1 to 10 mils (25 to 250 micrometers) in thickness and it should be capable of being pulled back upon itself without rupture. As a practical matter the backing should have a uniform thickness across its width and along its length. For convenience of removal of the adhesive strip from a container end, the backing should neither break nor elongate more than 25% under a tension of 4 pounds (1.8 kg). To provide a closure which will withstand the forces exerted on it with an adequate margin of safety, the backing material at a width of one inch (2.54 cm) should have a strength at break of at least 15 pounds (6.8 kg).

Representative materials which have been found suitable as backing members 18 include tough plastic films which have been oriented and heat-set in manners which are well known in the art in order to impart requisite properties of toughness and heat-resistance. Suitable films include polyethylene, polypropylene, polyethylene terephthalate, polytetramethylene terephthalate, polycarbonate, 6-6 Nylon (e.g., that available under the trade designation "Zytel ST 801 HS" from E. I. duPont de Nemours Co.), physical blends of polytetramethylene terephthalate/polyethylene, physical blends of polytetramethylene terephthalate/polyethylene terephthalate, physical blends of polytetramethylene terephthalate/phenoxy, glycol modified polyethylene terephthalate, unplasticized polyvinylchloride, polyethylene terephthalate/polyethylene composites and films derived from a graft copolymer comprising acrylonitrile/methylmethacrylate copolymer grafted onto an acrylonitrile/butadiene copolymer backbone (e.g., that available under the trade designation "Barex" from Vistron Corporation). A particularly suitable film is a 2-mil (50 micrometer) biaxially-oriented film of polyethylene terephthalate, the film also containing a polycarbonate slip agent of the type disclosed in U.S. Pat. No. 3,720,732 (Sevenich), incorporated herein by reference. Other representative materials include thin metal foils (e.g., aluminum, steel, etc.), as well as metal foil-film composites.

Tapes useful as closure tab 15 have a pressure-sensitive adhesive layer 19 which will withstand a dead shear load of 8.8 psi (60.7 kPa) at 140° F. (60° C.) for at least 1000 minutes. This shear strength test is described in said U.S. Pat. No. 3,389,827.

Preferred pressure-sensitive adhesives are the block copolymer-containing adhesives described in said U.S. Pat. No. 3,389,827. Preferred block copolymers are those having the general configuration A-B-A, wherein each A is a thermoplastic polymer block having a glass transition temperature above room temperature and having an average molecular weight between about 5,000 and 125,000, and B is a polymer block of a conjugated diene having an average molecular weight between about 15,000 and 250,000.

One particularly suitable pressure-sensitive adhesive of this type comprises 100 parts by weight of "Kraton 1101" (a block copolymer of styrene and butadiene having one butadiene polymer block of 70,000 molecular weight and two styrene polymer blocks of 15,000 molecular weight, commercially available from Shell Chemical Company), 76 parts by weight of "Piccolyte A-135" (an alpha-pinene resin, commercially available from Hercules Chemical Company) and 0.8 parts by weight of "Ethyl Antioxidant 330" (1,3,5-trimethyl-2,4,6-tris[3,5-ditert-butyl-4-hydroxybenzyl] benzene), commercially available from Ethyl Corporation.

Other suitable pressure-sensitive adhesives include the acrylic copolymer-containing adhesives described in said U.S. Pat. No. 3,389,827. A particularly suitable adhesive of this type comprises an isooctyl acrylate (90)/acrylic acid (10) copolymer which has been cross-linked through addition of benzoyl peroxide in an amount of about 0.01 to 0.5 percent by weight of the acrylic copolymer.

Employment of a primer, while optional, is desirable in order to assure secure bonding of the adhesive layer to the tape backing. Useful primers are described in said U.S. Pat. No. 3,990,603 (Brochman), and include polycarbodiimide polymers, a polyurethane (comprising the reaction product of 11.4 parts polyester diol, eq. wt. 8,000 and 1.1 parts polymethylene-polyphenylisocyanate, eq. wt. 132), and phenoxy resin (comprising thermoplastic condensation product of bisphenol A and epichlorohydrin, molecular weight about 30,000, with no terminal epoxy groups, commercially available from Union Carbide under the trade designation "Phenoxy PKHH"). A particularly suitable primer for use with the preferred polyethylene terephthalate film backing is the linear saturated soluble polyester which is available under the trade designation "Vitel PE 222" from B. F. Goodrich Co. This polyester comprises the following residues (amounts indicated in a molar basis): terephthalic acid (23%), isophthalic acid (21%), aliphatic diacids (7%), ethylene glycol (27%) and neopentyl glycol (21%).

The tab can be rendered opaque by means of pigmentation of the tape backing as the backing is extruded, by means of vapor coating the tape backing with a thin layer of metal (e.g., aluminum, silver, copper, etc.) or by means of coating a dispersion of pigment onto the tape backing. A vapor coat may be desirable since it functions to improve the impermeability (e.g., to air and moisture) of the film backing. In the case of a vapor coat, it is often desirable to apply a top coat over the vapor coat in order that the latter be protected from any abrasion which can cause an undesirable appearance of the tab. One particularly useful material for a topcoat is "Vitel PE 222", discussed above as also being a suitable primer.

It is barrier layer 16 of protective tape 14 which provides a barrier to the essential oils contained in a particular juice or drink product. While functioning as a barrier, barrier layer 16 must also have properties which permit it to be torn and removed in the area of the pour hole when closure tab 15 is removed. Thus, the tear strength of barrier layer 16 should not exceed the strength of bond between closure tab 15 and protective tape 14. Also, the barrier layer tear strength should not exceed the strength of the bond between the thermoplastic adhesive layer and the barrier layer. The barrier layer may be, for example, about 0.1 to 2 mils in thickness. A barrier layer 16 of about 0.25 to 1 mils in thickness is preferred in the practice of the present invention.

Suitable materials barrier layer 16 of protective tape 14 include plastic films comprising copolymers of vinylidene chloride and vinylchloride (e.g., the film available under the trade designation "Saran Wrap" from Dow Chemical Company), and films comprising copolymers of vinylidene chloride and acrylonitrile (e.g., the resin available under the trade designation "Saran F-310" from Dow Chemical Company). A preferred barrier layer 16 is prepared from an aqueous dispersion of latex (e.g., the dispersion available under the trade designation "Saran Latex XD-30373" from Dow Chemical Company).

Other suitable materials for barrier layer 16 include thin metal foils (e.g., those comprising aluminum or tin) or metal foil-film composites.

Thermoplastic adhesives suitable for protective tape 14 must be resistant to the oil (e.g., essential oils) contained in the product being packaged in order to provide suitable bonding performance. Generally, an adhesive coating of about 0.5 to 3 mils in thickness is suitable in the practice of the present invention.

Suitable thermoplastic adhesives include segmented block copolyesters, terpolymers of ethylene/-vinylacetate/acrylic acid (e.g., that available under the trade designation "Elvax 4260" from E. I. duPont deNemours Company), copolymers of ethylene/vinyl acetate (e.g., that available under the trade designation "Airflex 416" from Air Products and Chemicals, Inc.), and polyester-urethane elastomers (e.g., those available under the trade designations "Texin 480A" and "Texin 480F" from Mobay Chemical Company). A preferred thermoplastic adhesive is an FDA-approved version of "Dyvax PB5050" (commercially available from E. I. duPont de Nemours Company). "Dyvax PB5050" comprises a thermoplastic copolyester elastomer wherein the molar ratio of acid to glycol is 1:1, and the acid is a 70/30 blend of terephthalic acid and isophthalic acid. The glycol is an 80/20 blend of 1,4-butanediol and polytetramethylene ether glycol (1000 mol. wt.).

When the thermoplastic adhesive is to be applied to an intact barrier layer, the adhesive may simply be extrusion coated or solvent-cast onto the layer. When an aqueous dispersion such as the above-mentioned "Saran Latex XD-30373" is employed to prepare the barrier layer, it has been found convenient to first extrude the thermoplastic adhesive onto a carrier web such as a 1 or 2 mil (25 or 50 micrometers) untreated, biaxially-oriented polypropylene film and to then Meyer bar or rotogravure coat the resulting adhesive layer with the latex dispersion. The carrier web functions as a carrier substrate during tape manufacture and as a removable liner.

A preferred protective tape 14 comprises a 0.5 mil (12.5 micrometers) barrier layer 16 prepared from the above-mentioned "Saran Latex XD-30373" and a 1.5-mil adhesive layer comprising the above-mentioned "Dyvax PB5050".

The closure system illustrated in FIGS. 1 to 3 will withstand forces at 72° F. of between about 25 inches of mercury vacuum and about 10 pounds per square inch of pressure. In an alternative embodiment of the closure system of the present invention, the protective tape comprises a barrier layer, a frangible film, and a layer of thermoplastic adhesive. Suitable barrier layers and thermoplastic adhesives have already been discussed hereinabove. The frangible film is preferably about 0.25 to 1 mil (6.25 to 25 micrometers) in thickness and is employed in order to permit the closure system to withstand greater pressures such as are encountered in ambient or nitrogen-assisted packaging of products. The barrier layer may be situated between the thermoplastic adhesive and the frangible film. Alternatively and preferably, the barrier layer is situated on the side of the frangible film opposite the thermoplastic adhesive layer. These embodiments are adapted to withstand forces at 72° F. of between about 25 inches of mercury vacuum and about 20 pounds per square inch pressure.

The protective tapes described herein are frangible in nature and care should be taken in applying these tapes to container ends. A preferred device for applying both the protective tape and the exterior closure tab are described in copending application Ser. No. 264,832 filed of even date and commonly assigned, incorporated herein by reference. That device comprises a heated platten which activates the thermoplastic adhesive of the protective tape and bonds the protective tape to the container end. The exterior closure tab is brought into contact with and bonded to the container end by means of a stream of compressed air. The stream of compressed air also functions to deform the exterior closure tab into the cavity of the preformed opening.

The container end portion illustrated in FIG. 1 is one possible embodiment which may be employed in the closure system of the present invention. The scored container end portion described in copending application U.S. Ser. No. 264,657 filed of even date and commonly assigned, incorporated herein by reference, may also be employed in the manner disclosed therein.

We claim:

1. An easy opening closure system comprising a container end portion having an opening therein, said closure system further comprising:

(a) an exterior tape comprising a backing and a pressure sensitive adhesive layer, said exterior tape being situated circumjacent said opening and being firmly adhered to the top surface of said container end portion circumjacent said opening by means of said pressure-sensitive adhesive layer; and (b) a protective tape comprising a barrier layer and an oil-resistant thermoplastic adhesive layer firmly bonded to said barrier layer, said protective tape being firmly bonded to the bottom surface of said container end portion circumjacent said opening by means of said thermoplastic adhesive layer, and further being firmly bonded to said exterior tape in the area of said opening by means of said pressure-sensitive adhesive layer and said thermoplastic adhesive layer.

2. An easy opening closure system in accordance with claim 1, wherein said backing of said exterior tape is selected from the group consisting of polyethylene, polypropylene, polyethylene terephthalate, polytetramethylene terephthalate, polycarbonate, 6-6 Nylon, physical blends of polytetramethylene terephthalate/-polyethylene, physical blends of polytetramethylene terephthalate/polyethylene terephthalate, physical blends of polytetramethylene terephthalate/phenoxy, glycol modified polyethylene terephthalate, unplasticized polyvinylchloride, polyethylene terephthalate/-polyethylene composites, films derived from graft copolymers comprising acrylonitrile/methylmethacrylate copolymer grafted onto an acrylonitrile/butadiene copolymer backbone, thin metal foils and metal foil-film composites.

3. An easy opening closure system in accordance with claim 1, wherein said pressure-sensitive adhesive comprises a block copolymer having the general configuration A-B-A, wherein each A is a thermoplastic polymer block having a glass transition temperature above room temperature and having an average molecular weight between about 5,000 and 125,000, and wherein B is a polymer block of a conjugated diene having an average molecular weight between about 15,000 and 250,000.

4. An easy opening closure system in accordance with claim 1, wherein said pressure-sensitive adhesive layer comprises an acrylic copolymer.

5. An easy opening closure system in accordance with claim 3, wherein said block copolymer has the configuration polystyrene-polybutadiene-polystyrene.

6. An easy opening closure system in accordance with claim 1, wherein said barrier layer is selected from the group consisting of films of vinylidene chloride/vinyl chloride copolymers, films of vinylidene chloride/acrylonitrile copolymers, films of latex, metal foils and metal foil-film composites.

7. An easy opening closure system in accordance with claim 1, wherein said thermoplastic adhesive layer comprises polymers selected from the group consisting of segmented block copolyesters, terpolymers of ethylene/vinyl acetate/acrylic acid, ethylene/vinyl acetate copolymers and polyester-urethane elastomers.

8. An easy opening closure system comprising a container end portion having an opening therein, said closure system further comprising:

(a) an exterior tape comprising a backing and a pressure-sensitive adhesive layer, said exterior tape being situated circumjacent said opening and being firmly adhered to the top surface of said container end portion circumjacent said opening by means of said pressure-sensitive adhesive layer; and (b) a protective tape comprising a barrier layer, a frangible film, and an oil-resistant thermoplastic adhesive layer, said barrier layer being situated between said frangible film and said thermoplastic adhesive layer, said protective tape being firmly bonded to the bottom surface of said container end portion circumjacent said opening by means of said thermoplastic adhesive layer, and further being firmly bonded to said exterior tape in the area of said opening by means of said pressure-sensitive adhesive layer and said thermoplastic adhesive layer.

9. An easy opening closure system comprising a container end portion having an opening therein, said closure system further comprising:

(a) an exterior tape comprising a backing and a pressure-sensitive adhesive layer, said exterior tape being situated circumjacent said opening and being firmly adhered to the top surface of said container end portion circumjacent said opening by means of said pressure-sensitive adhesive layer; and (b) a protective tape comprising a barrier layer, a frangible film, and an oil-resistant thermoplastic adhesive layer, said frangible film being situated between said barrier layer and said thermoplastic adhesive layer, said barrier layer being situated between said frangible film and said thermoplastic adhesive layer, said protective tape being firmly bonded to the bottom surface of said container end portion circumjacent said opening by means of said thermoplastic adhesive layer, and further being firmly bonded to said exterior tape in the area of said opening by means of said pressure-sensitive adhesive layer and said thermoplastic adhesive layer.

10. An easy opening closure system in accordance with claim 1, wherein said closure system is adapted to withstand forces at 72° F. of between about 25 inches of mercury vacuum and about 20 pounds per square inch pressure.

11. An easy opening closure system in accordance with claim 8, wherein said closure system is adapted to withstand forces at 72° F. of between about 25 inches of mercury vacuum and about 20 pounds per square inch pressure.

12. An easy opening closure system in accordance with claim 9, wherein said closure system is adapted to withstand forces at 72° F. of between about 25 inches of mercury vacuum and about 20 pounds per square inch pressure.

* * * * *